United States Patent [19]

Bertacchi et al.

[11] 4,081,938

[45] Apr. 4, 1978

[54] STANDOFF INSULATED PANEL MOUNTING

[76] Inventors: Ralph Bertacchi; Frederick R. Gorell, both of 55 E. Jackson, Chicago, Ill. 60604

[21] Appl. No.: 750,281

[22] Filed: Dec. 13, 1976

[51] Int. Cl.[2] ..... E04B 5/00

[52] U.S. Cl. ..... 52/410; 52/483; 52/618; 52/714

[58] Field of Search ..... 52/410, 618, 483, 269, 52/714, 713, 404

[56] References Cited

U.S. PATENT DOCUMENTS 2,256,961 9/1941 Pearson et al. ..... 52/410 X

*Primary Examiner*—Ernest R. Purser
*Assistant Examiner*—Carl D. Friedman

[57] ABSTRACT

A combination standoff support and mounting bracket for an insulated panel, with the support providing rigidity between an outer metallic surface of the insulated panel and a structural member upon which the panel is to be mounted while retaining the composition of the insulation in the panel together as an integral unit.

4 Claims, 6 Drawing Figures

Fig. 1.
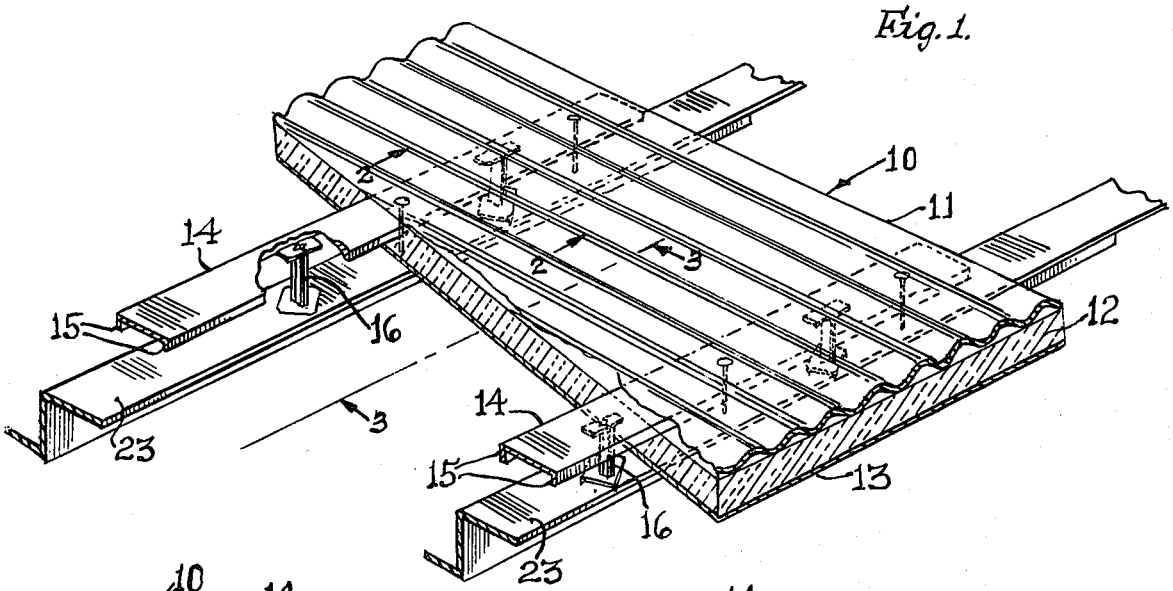
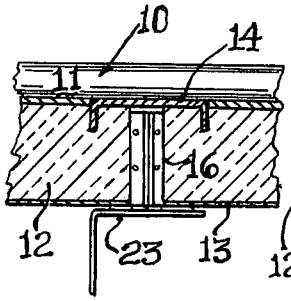
Fig. 2.
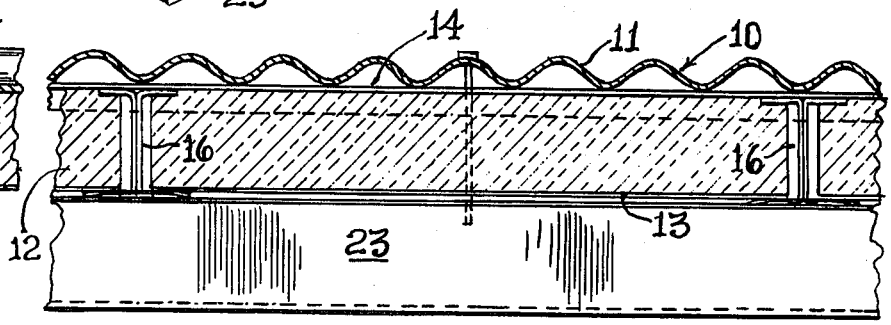
Fig. 3.
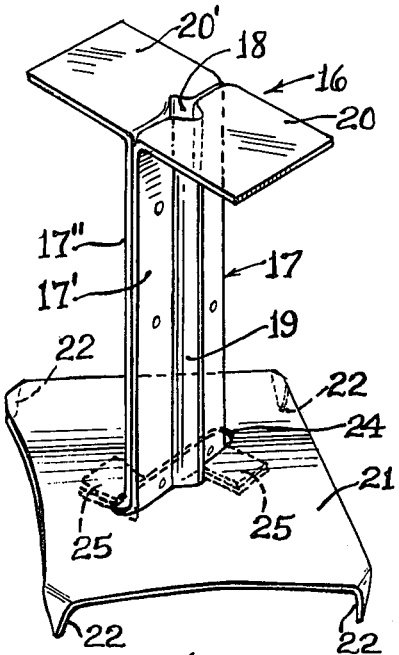
Fig. 4.
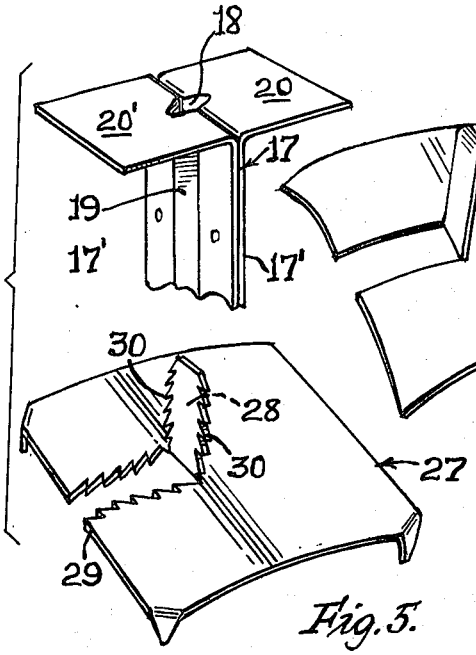
Fig. 5.
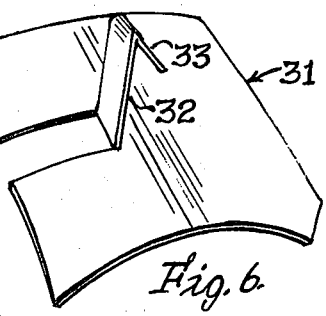
Fig. 6.

STANDOFF INSULATED PANEL MOUNTING

SUMMARY OF THE INVENTION

Insulated panels, such as that described in U.S. Pat. No. 3,377,760, consist of a multiple layer of elements, one of which may be a fiberglass batt or a plurality of crimped foil material which inherently does not possess any significant rigidity. When in use, the insulation panel of the construction noted is subject to compression. The layers thereof will become compressed, and the panel in turn loses much of its efficiency as insulation.

It is an object of this invention to provide a standoff mounting for the insulated panel which will also function to maintain the insulated panel in a prefabricated condition.

A further object of the invention is to provide a minimum contact between the standoff mounting of the insulated panel and the structure upon which it is supported so as to reduce the amount of temperature transmitted therethrough. To accomplish this end, there is provided a specifically constructed base washer which is generally concave in the direction away from the support on which it is mounted, with only corner prongs thereof in actual physical contact with the support. The washer base will also provide a lock member by which it is connected to the longitudinal length of the standoff mounting, which then, in turn, will function as a means of maintaining the insulated prefabricated panel in its preformed condition.

GENERAL DESCRIPTION

The invention by which the objects are achieved is shown in the accompanying drawings depicting the preferred form of embodiment, and in which:

FIG. 1 is a fragmentary perspective view of one insulated panel including the standoff mounting therefor;

FIG. 2 is a fragmentary detailed side sectional view taken on line 2—2 of FIG. 1;

FIG. 3 is a fragmentary detailed sectional view taken on line 3—3 of FIG. 1;

FIG. 4 is a perspective view of one form of the standoff mounting bracket in an assembled condition;

FIG. 5 is a fragmentary perspective view of a modified form of the standoff mounting; and FIG. 6 is a perspective view of a modified washer base usable with the invention.

In many structures today there is a requirement for thermal insulation of hot air and gas ducts as well as full structural chambers. To insulate these stuctures there is used a prefabricated insulating panel 10 which comprises an outer metallic sheet 11 which may be corrugated, as shown, but other forms are as readily applicable to the invention without departure therefrom. To the under side of the metallic sheet 11 is placed a batt of insulation 12 which may be formed from fiber glass or the like, as shown, or a multiple layer of crinkled or preformed foil or aluminum sheets. It is obvious that this batt of insulation has little rigidity against compression when formed into the batt associated with the prefabricated panel 10, as shown. To the exposed surface of the batt of insulation 12 is mounted a backing 13 which may be another sheet of reflective foil or a wire mesh, the purpose of which is to hold together the panel in its prefabricated form. The elements of these panels may be held together with a prong type connection shown in the afore-mentioned patent, which may be supplemented by the standoff mounting of the present invention.

The present construction of the standoff mounting requires a metallic support plate 14 generally channel-shaped as shown and positioned on the under side of the metallic sheet 11. The insulated batt 12 may be forced upon the spaced laterally extending flanges 15 of the support 14 so as to provide some degree of connection therebetween. Fastened to the underside of the support 14 is a standoff mounting 16 (FIGS. 1, 2 and 4).

As shown, the standoff mounting consists of an elongated support 17, preferably constructed from two metallic plates 17' and 17'', which have been preformed so as to provide an open channel 18 which extends the length of the support 17. As presently shown, this channel 18 is formed by having each of the plates 17' and 17'' die-stamped with a triangular medial rib 19, which when placed in confronting relation, as shown in FIG. 4, forms the channel 18. One end of each plate 17' and 17'' is bent in opposite directions so that each provides a transversely extending mounting face 20 and 20'. These faces 20 and 20' are adapted to support the under side of the elongated support 14. The support 17 may have impinged thereon the insulation batt 12 so as to aid in the interconnection of all of the elements of the panel, as heretofore described.

After the insulation batt 12 has been impinged on the support 17, the base washer 21 is adapted to be latched onto the opposite free end of the support 17. As shown in FIG. 4, the base washer 21 is substantially rectangular in cross section and is concave in a direction toward the mounting face 20. The four corners of the base washer 21 form pointed prongs 22 which, in turn, are adapted to sit upon a rigid structural support 23 provided by the air duct or chamber to be insulated.

In the center of the base washer 21 there is formed an elongated slot 24 extending inwardly from one corner to an opposite corner thereof. The adjacent ends of each of the plates 17' and 17'' above their medial ribs 19 removed so as to present two tabs 25 which are adapted to be projected through the slot 24 formed in the base washer 21 and then bent in opposite directions, as shown, so as to fasten the base washer 21 to the support 17 of the standoff mounting 16.

In FIG. 5 there is shown a modified form of the base washer 27, which has an upstanding lug 28 formed by serrating inwardly from one edge 29 of the base washer 27 two parallel cuts so that the lug 28 may be bent in a perpendicular relation to the base washer 27, as shown. The support 17 is formed so as to be devoid of the tabs 25 so that the support 17 may be force-fitted upon the lug 28, with the lug 28 having its serrated side edges 30 projected into the triangularly shaped medial portion 18 of the support 17, locking the same to the base washer 27.

In FIG. 6 there is shown a still further modification of the base washer 31 which provides an upstanding lug 32 having a reversely angled locking finger 33. Thus, when the support 17 of the standoff mounting 16 is forced onto the base washer 31, the lug 32 will project into the medial portion 18 of the support 17 and be held thereby by frictional contact established between the finger 33 and the inner walls of the support 17.

From the foregoing, it is apparent that there is provided an elongated standoff mounting which by its configuration possesses sufficient rigidity so as to resist compression thereof. When the same has mounted thereon an insulating panel it will prevent the panel from being compressed so as to lose its insulating characteristics. The standoff mounting also functions to hold together as a prefabricated unit the insulating panel utilized. The limited contact between the base washer of the standoff mounting and the internal structural member upon which it is mounted, reduces the amount of heat transfer therebetween and thereby does not detract from the insulating qualities of the panel and its mounting, as designed.

While we have illustrated and described the preferred form of construction for carrying our invention into effect, this is capable of variation and modification without departing from the spirit of the invention. We therefore do not wish to be limited to the precise details of construction set forth, but desire to avail ourselves of such variations and modifications as come within the scope of the appended claims.

Having thus described our invention, what we claim as new and desire to protect by Letters Patent is:

1. A support mounting for a prefabricated insulating panel having an outer metallic surface, a batt of insulating material and a backing therefor, comprising (a) an elongated panel-supporting plate extending transversely of the panel beneath the outer metallic surface and between the batt of insulating material and the outer metallic surface, (b) a rigid standoff member connected to one side of and extending perpendicularly to the panel-supporting plate, (c) said standoff member providing an elongated hollow body adapted to be embedded in and extending through the batt of insulating material, (d) a base member connected to the free end of said body exteriorly of the batt of insulating material and extending in substantially parallel relation to said panel-supporting plate and adapted to sit upon a fixed structural member so as to support the panel therefrom, with said standoff member preventing displacement of the insulating panel onto the support under weight placed thereon, and (e) means providing a connection between said base member and said free end of said body of said standoff member so as to attach said base member in a plane substantially parallel to said elongated panel-supporting plate.

2. A support mounting for a prefabricated insulating panel as defined by claim 1, wherein said base member is generally rectangularly shaped and is concave in the direction of said panel-supporting plate, with each of its corners thereof bent out of its normal plane in the direction of the fixed structural member so as to have minimum surface contact therewith while supporting the insulating panel from the fixed structural member.

3. A support mounting for a prefabricated insulating panel as defined by claim 1, wherein said connecting means between said base member and said free end of said body of said standoff member comprises a pair of bendable locking tabs formed on said free end of said body and adapted to be projected through a corresponding opening formed in said base member, with said tabs bent out out of their normal plane into facial abutment with one surface of said base member so as to connect said standoff member thereto.

4. A support mounting for a prefabricated insulating panel as defined by claim 1, wherein said means providing a connection between said base member and said free end of said body of said standoff member comprises a latching finger extending perpendicularly from the center of said base member and adapted to be frictionally inserted into said elongated hollow body of said standoff member for connecting said base member to said free end of the body of said standoff member.

* * * * *